United States Patent [19]

Lingenfelter

[11] Patent Number: 4,630,455

[45] Date of Patent: Dec. 23, 1986

[54] TRIPLE ROLL, LAYER TOP, SOCK

[75] Inventor: Ralph E. Lingenfelter, Union Point, Ga.

[73] Assignee: Chipman-Union, Inc., Union Point, Ga.

[21] Appl. No.: 591,175

[22] Filed: Mar. 19, 1984

[51] Int. Cl.[4] ..... D04B 9/46

[52] U.S. Cl. ..... 66/172 R; 66/172 E; 66/173; 2/239

[58] Field of Search ..... 2/239; 66/169, 172 R, 66/172 E, 173–199

[56] References Cited

U.S. PATENT DOCUMENTS

| | | | |
|---|---|---|---|
| 2,153,423 | 4/1939 | Longtin | 66/173 |
| 2,223,808 | 12/1940 | Rambo | 66/173 |
| 2,872,800 | 2/1959 | Davis, Jr. et al. . | |
| 3,162,029 | 12/1964 | Laws et al. . | |
| 3,479,843 | 11/1969 | Shields | 66/173 |
| 4,034,580 | 7/1977 | Holder . | |
| 4,282,726 | 8/1981 | Wilkins . | |
| 4,304,108 | 12/1981 | Chamlee . | |

FOREIGN PATENT DOCUMENTS

| | | | |
|---|---|---|---|
| 746278 | 3/1956 | United Kingdom | 66/173 |
| 750166 | 6/1956 | United Kingdom | 66/173 |

OTHER PUBLICATIONS

Linton, George E., "The Modern Textile and Apparel Dictionary", 4th Rev. Enlarged Ed., 1973, p. 341.

Federal Standard, "Stitches, Seams, and Stitching & Fed. Std. No. 751, Mar. 4, 1930.

Reichman, "Kitting Dictionary", 1966, National Knitted Outerwear Assoc., N.Y., N.Y., pp. 85–86.

Concept, H. E. Crawford Co., Inc. brochure, 1135 Old Greensboro Rd., P.O. Box 747, Kernersville, N.S. 27284, U.S.A.

*Primary Examiner*—Ronald Feldbaum

*Attorney, Agent, or Firm*—Newton, Hopkins & Ormsby

[57] ABSTRACT

The top of the sock is formed of a welt and then three successive rolled stripe increments formed of stripe yarn of different colors and an elastic yarn which is laid in continuously throughout the length of the top. All three striped increments are connected at about a common location to the upper portion of the body by lock stitches.

15 Claims, 3 Drawing Figures

TRIPLE ROLL, LAYER TOP, SOCK

BACKGROUND OF THE INVENTION

1. Field of the Invention

This invention relates to an improved sock construction and is more particularly concerned with a triple roll, layered top sock and process of producing the same.

2. Description of the Prior Art

In the past, socks have been knitted using circular knitting machines in which the top has been formed using elastic yarn. Socks have also been produced in which the top is rolled to provide more than one rolled increment. Such prior art construction, however, does not employ the knitting techniques of the present invention or provide a sock which can be readily and inexpensively produced, using a single cylinder circular knitting machine.

SUMMARY OF THE INVENTION

Briefly described, the product of the present invention includes a sock known as a "footee" which is produced automatically on a circular knitting machine. The top of the sock is the novel portion and the body is conventional The top has a triple roll and is layered, being formed by three successively individually rolled strip or top increments. The yarns for all increments have at least one stripe yarn and one elastic yarn.

The first stripe increment has a welt at its first edge border or boundary portion and has a 3×1 mock rib construction. It is rolled back against itself with its first edge joined to the outer surface of the neck of the body, at the boundary portion of the body and the third stripe increment, by a first lock stitch formed by one or several, courses of the first stripe yarn and the elastic yarn.

The second stripe increment is of 1×1 mock rib construction and has common border or boundary portions with the first stripe increment and the third strip increment. Its boundary portions are joined together by the second lock stitches. The common boundary portion of the second and third stripe increments is also joined to the body by third lock stitches of one or several courses of the second stripe yarn and the elastic yarn. The second stripe increment is thus rolled back against itself and stands upright.

The third stripe increment is also of 1×1 mock rib construction and has common boundaries with the second stripe increment and the body of the sock. It is rolled against itself and is longer than the second stripe increment. The second and third stripe increments extend upwardly and the third strip increment downwardly. The second stripe increment thus circumscribes the lower portion of the third stripe increment. The first stripe increment circumscribes the upper portion or neck of the body. The body itself is of conventional knit construction, and usually includes a heel and toe. The body can be a tube.

The process of the present invention for producing the sock described above is carried out on the circular knitting machine, as follows:

1. Four courses of welt forming a single end of elastic yarn are layed in, using alternate needles, and the first elastic yarn finger is lifted.

2. The first stripe yarn finger and the second elastic yarn then drop down.

3. Every needle is selected "up" for one round, for laying in one course of a first stripe yarn to form with the four courses of first elastic yarn, the welt.

4. Next a 3×1 mock rib is sewn for 28 courses of the first stripe yarn and elastic yarn, knitting on groups of three needles and holding down on each fourth needle. Thus, the fourth needles hold the two ends of yarn in the first course for later producing the first lock stitches.

5. The second stripe yarn finger drops down and the first stripe yarn finger is withdrawn. This produces a change over of yarn from the first color to the second color and a course or two which has five ends of yarn therein, forming a first common boundary.

6. At about the same time as the change over from the first stripe yarn to the second stripe yarn, the machine shifts from the 3×1 mock rib operation to a 1×1 mock rib operation in which the originally held down needles remain down and the middle needles of each group of three needles from the 3×1 operation is held down. Thus, the then held down needles hold on course of yarn at the vicinity of the first boundary for use later in forming the second lock stitches.

7. The 1×1 operation runs for 28 courses.

8. Next the machine goes back to a 3×1 mock rib operation for four courses, thereby releasing second lock stitch course for being knitted into the fabric being formed. This sews the boundaries of the second strip increment together.

9. Next a color change takes place in which the second stripe yarn finger is withdrawn and the third stripe yarn finger is dropped down. Also, the machine goes to a 1×1 mock rib operation and runs for 28 courses. The change from the 3×1 mock rib operation to the 1×1 mock rib operation causes a third lock stitch yarn to be held down.

10. After the 28 courses of the third stripe yarns, the body yarn fingers drop in and the third stripe yarn finger is withdrawn. The machine begins knitting with all needles and in a conventional way the body of the sock is produced. When the machine begins knitting with all needles, the first lock stitches (for joining the welt to the body) are produced and the third lock stitches for joining the second boundary to the body are also produced.

Accordingly, it is an object of the present invention to provide a triple roll, layered top for sock construction which is inexpensive to manufacture, durable in structure and unusual in appearance.

Another object of the present invention is to provide a sock construction which has a plurality of rolled striping yarn increments which are joined together during the knitting operation and will maintain their shape through repeated washings.

Another object of the present invention is to provide a triple roll layered top for sock construction which can be readily and easily produced using a conventional single cylinder circular knitting machine.

Another object of the present invention is to provide a "footee" sock which has a top which will yieldably hold the sock against being gathered into a shoe.

Other objects, features and advantages of the present invention will become apparent from the following description when taken in conjunction with the accompanying drawings wherein like characters of reference designate corresponding parts throughout the several views.

DESCRIPTION OF THE PREFERRED EMBODIMENT

Figure 1:
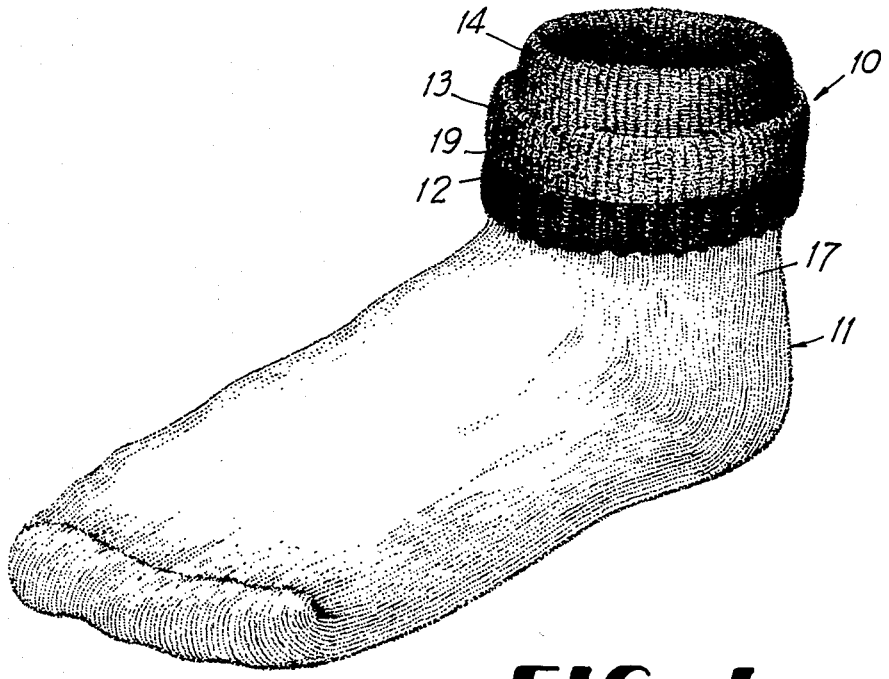
FIG. 1 is a perspective view of a sock constructed in accordance with the present invention.
Figure 2:
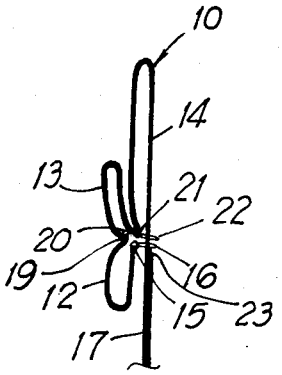
FIG. 2 is an exploded vertical sectional view showing the courses of the top portion and upper part of the body of the sock shown in FIG. 1.
Figure 3:
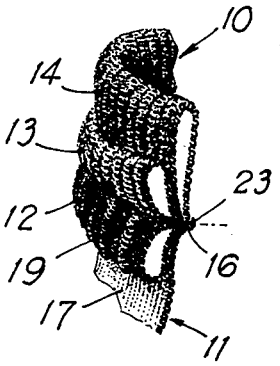
FIG. 3 is a fragmentary perspective view of the upper portion of the body and the top of the sock shown in FIG. 1.

Referring now in detail to the embodiment chosen for the purpose of illustrating the present invention, numeral 10 in FIG. 1, 2 and 3 denotes generally the top of a "footee" sock, constructed in accordance with the present invention. Numeral 11 denotes the body of the sock. This sock is knitted on a conventional single cylinder circular knitting machine known as a CONCEPT T.S., made by H. E. Crawford Company of Kearnersville, N. C. Such a machine has a four inch cylinder and 108 needles.

When the machine is set up to run, it has eight yarns supplied to it through its various yarn fingers. In a typical set up, a first elastic yarn finger carries a 6/17 elastic yarn for forming only the welt of sock. A stripe finger, however, carries a second 6/17 elastic yarn which will run throughout the entire top 10. Another stripe finger is threaded with two ends of 1/18 dyed orlon yarn which, for this explanation, is aqua in color. These yarns form the first or outer, downwardly protruding rolled, top or stripe increment 12.

Still another stripe finger is provided with two ends of 10/1 polyester yarn which is, for example, white. These yarns form the upwardly rolled, second or outer top or stripe increment 13 of the sock.

Still another stripe finger carries two ends of 1/18 dyed orlon yarns. These yarns form the upwardly rolled third or inner top or stripe increment 14. These yarns are, for example, blue.

The body yarns are carried by two additional fingers, one finger carrying a 2×70/24 nylon and the other finger carrying a 14/1 ring spun cotton.

In commencing construction of the sock on the circular knitting machine, the elastic welt finger first moves in and the cylinder of the machine makes four complete revolutions. This lays in the elastic yarn for the welt or edge 15.

Thereafter, the first or stripe yarn finger and the second elastic finger drop in. The second elastic yarn thus remains "dropped in" for the entire top so that the top is produced using a combination of two striping yarns and the elastic yarn.

With the first stripe yarn finger down and the elastic finger down, the machine goes into a 3×1 mock rib operation and runs this 3×1 mock rib operation for a predetermined number of courses. Usually, about 28 courses are preferred; however, from 15 to about 30 courses can conveniently be used, for producing a tubular knitted section which forms the first stripe or top increment 12. When running the 3×1 mock rib, I hold, with the down needles, the two ends of stripe yarn and the end of elastic yarn which are created in the first course of the first 3×1 mock rib stripe increment 12 and then continue to hold this one course with the down needles throughout the knitting of substantially the entire top 10.

After the knitting of the frist increment 12, I then shift into a 1×1 mock rib knitting operation and change the stripe yarns to a different color. For the purpose of this explanation, the second color can be considered as white. At the time of the changeover, I continue to hold the aqua strip yarns and their accompanying elastic yarn with each fourth down needle, thereby permitting these yarns, when released, later to be knitted as second lock stitches 16 at completion of top 10. When the sock is completed, the first top increment 12 is held by stitches 16 and loops downward over the neck 17 of the body 11 and the welt portion 15. The changeover for the first border or boundary 19 causes one to several courses to be knitted having the first color (aqua) and the second color (white) yarns therein.

I then commence a 1×1 mock rib knitting operation and continue this for a predetermined number of courses, usually about 28 courses or from about 10 to about 30 courses, still holding down on each fourth needle. The shift from 3×1 mock rib construction to 1×1 mock rib construction at border 19, causes each middle needle of the group of three needles forming the 3×1 mock rib to go down, thereby permitting these needles to hold one course of yarns adjacent to border 19. This held yarn is destined to form the second lock loops or stitches 20. Thus, I produce an upwardly extending, rolled 1×1 mock rib second increment 13 which is of less length than the third increment 14.

Next there is a second stripe color change produced by movement of the white stripe finger out and the blue stripe finger in. This produces border or boundary 21 between the second increment 13 and the third increment 14. At about that time the machine goes back to a 3×1 mock rib construction for only about four (from about 2 to about 5) courses permitting, thereby, the middle needles to release the held course for producing the second lock stitches 20, as the 3×1 construction begins. Upon completion of the four courses, the machine returns to the 1×1 mock rib construction. This causes the middle needles to again hold a course of yarn which will subsequently produce the third lock stitch 22.

The release the held down middle needles, as the border 21 is produced, stitches border 19 to border 21. This action forms the rolled upstanding second or outer stripe increment 13.

When this third stripe increment 14 approaches completion, there is a changeover of yarn to a conventional body yarns, the machine producing the conventional body 12 of the sock, using a flat knit and body yarns. At the changeover or border 23 between the third or blue stripe yarns and the body yarns, the elastic yarn is discontinued and the held yarns are released, because all needles begin knitting. This causes tacking, sewing or knitting the lock stitches 16 and 22 at the boundary or border 23 between the third increment 14 and the body 11, at essentially common points, which are at the junction or boundary 23 of the body and the top.

In the process of knitting, since the body 11 of the sock and the third stripe increment 14 are knitted last, the first and second rolled increments are outwardly of the body 11 and the third increment 14, respectively. Since the first and second increments 12 and 13 are attached at their border 19 along a generally common course, the first increment 12 naturally extends downwardly, as illustrated in FIGS. 1, 2 and 3, and the second increment 13 naturally stands upright, being disposed outwardly of the taller or longer third increment 14.

The reason that the third increment 14 is longer than the second increment 13 and stands well above increment 13 is that it has larger yarns therein and is of looser knit. A greater number of courses in increment 14 than in increment 12 can also produce this effect.

The resulting sock thus has its borders 19, 21 and 23 at an essentially common plane or location, being attached or held to each other by the lock stitches 16, 20 and 22.

It will be obvious to those skilled in the art that many variations may be made in the embodiment here chosen for the purpose of illustrating the present invention without departing from the scope thereof as defined by the appended claims.

I claim:

1. A knitted sock of the type having a body and a top connected to said body, said body having a neck portion adjacent to said top, wherein the improvement comprises the top including a first top increment, a second top increment connected along a common first border portion to said first top increment, a third top increment connected along a common second border portion to said second top increment and along a common third border portion to said neck of said body, said first top increment having an outer edge for connection to said neck portion and extending downwardly from said outer edge and from said first border portion over the neck of said body, said third top increment extending from said third border portion and said second border portion upwardly from the neck of said body, said second increment extending upwardly from said first border portion and said second border portion in overlapping fashion over said third top increment, and means for securing said first increment and said third increment to said neck portion and for securing said second increment to said first increment.

2. The knitted sock defined in claim 1 wherein said means includes lock stitches disposed in spaced relation around said neck portion and adjacent to certain of the border portions for holding those border portions in position with respect to the remainder of said sock.

3. The knitted sock defined in claim 1 wherein said means includes a plurality of first lock stitches extending from said edge to said neck portion, a plurality of second lock stitches extending from the vicinity of said first border portion to the vicinity of said second border portion and a plurality of third lock stitches extending from the vicinity of said second border portion to said neck portion, said first lock stitches and said third lock stitches disposed adjacent one another in said neck portion.

4. The knitted sock defined in claim 1 wherein said first top increment has a $3\times1$ mock rib construction and said second top increment has a $1\times1$ mock rib construction.

5. The knitted sock defined in claim 4 wherein said third increment has a $1\times1$ mock rib construction.

6. A knitted sock of the type having a body and a top connected to said body, said body having a neck portion adjacent to said top, wherein the improvement comprises the top including first, second and third rolled top increments joined together along common border portions respectively, one of said roll top increments having an edge portion and extending over the neck of said body, the other two of said rolled increments extending in an opposite direction from said one of said rolled top increments and being arranged in overlapping fashion with respect to each other, and lock stitches for joining the edge portion of said first increment to the neck portion, said common border portion of said first and second increments, and said common border portion of said second and third increments to the neck portion of said body and lock stitches for joining the edge portion of said first increment to the neck portion, said common border portion of said first and second increments and said common border portion of said second and third increments to the neck portion of said body.

7. A process for producing a triple roll, layer top sock from yarns fed to a circular knitting machine comprising:

producing a first top increment of knitted fabric from successive courses of yarns for providing a $3\times1$ mock rib first top increment while holding yarn from one of the first courses, shifting to a $1\times1$ mock rib construction for producing a second top increment of knitted fabric from second courses of yarns while holding a second course of yarns, releasing said second held course of yarns to form lock stitches, shifting again to a $3\times1$ mock rib construction for additional courses and shifting again to $1\times1$ mock rib construction while holding certain of said additional courses, releasing said first and said additional held courses to form additional lock stitches and producing the body of said sock knitting with all needles.

8. The knitted sock as defined in claim 1 in which said border portions are formed by an elastic yarn and a body yarn.

9. The knitted sock as defined in claim 8 in which said elastic yarn and said body yarn are different in color.

10. A process for producing a triple roll, layer top sock from yarns fed to a circular knitting machine as defined in claim 7 comprising the further step of knitting common boundary portions between said first and second top increments, and between said second top increment and said second-mentioned $1\times1$ mock rib construction.

11. A process for producing a triple roll, layer top sock as defined in claim 10 comprising the further step of using an elastic yarn and a body yarn for said boundary portions.

12. A process for producing triple roll, layer top sock as defined in claim 11 comprising the further step of using a certain color of said elastic yarn and a different color for said body yarn.

13. A process for producing a triple roll, layer top sock from yarns fed to a circular knitting machine as defined in claim 10 wherein said second mentioned $1\times1$ mock rib construction comprises a third top increment, said process comprising the further steps of securing said boundary portions together and securing said secured portions to the body of the sock.

14. A process for producing a triple roll, layer top sock as defined in claim 7 comprising the further step of knitting a welt of elastic yarn for forming an edge for said first increment.

15. A process for producing a triple roll, layer top sock as defined in claim 14 comprising the further step of securing said welt to the body of the sock.

* * * * *